US006899517B2

(12) United States Patent
Gay et al.

(10) Patent No.: US 6,899,517 B2
(45) Date of Patent: May 31, 2005

(54) ATTACHMENT OF BEARING ELEMENTS BY DEFORMATION

(75) Inventors: Farral D. Gay, Claremore, OK (US); Terry W. Shafer, Broken Arrow, OK (US); B. Lyle Wilson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 59 days.

(21) Appl. No.: 10/290,924

(22) Filed: Nov. 8, 2002

(65) Prior Publication Data

US 2004/0091352 A1 May 13, 2004

(51) Int. Cl.[7] ..... F01D 3/00

(52) U.S. Cl. ..... 415/104; 416/198 R; 29/889.1; 384/420; 264/167

(58) Field of Search ..... 415/104, 206, 415/229; 416/198 R; 417/420, 423.12, 365; 29/889.1, 889.12, 889.2, 889.21; 384/420–427, 537; 264/167, 210.2, 210.5, 296, 284, 273; 24/452, 442; 428/100, 99

(56) References Cited

U.S. PATENT DOCUMENTS

| | | | | | |
|---|---|---|---|---|---|
| 3,713,713 | A | * | 1/1973 | Alling et al. | 384/622 |
| 3,932,061 | A | | 1/1976 | Scott | |
| 3,937,541 | A | | 2/1976 | Alling et al. | |
| 3,960,468 | A | * | 6/1976 | Boorse et al. | 417/423.13 |
| 4,404,483 | A | * | 9/1983 | Lebkuchner | 310/42 |
| 4,433,949 | A | * | 2/1984 | Hallock | 411/477 |
| 4,678,399 | A | | 7/1987 | Vandevier et al. | |
| 4,741,668 | A | | 5/1988 | Bearden | |
| 4,781,531 | A | | 11/1988 | James | |
| 4,872,808 | A | * | 10/1989 | Wilson | 415/170.1 |
| 4,955,786 | A | * | 9/1990 | Kunkel et al. | 415/110 |
| 5,421,592 | A | * | 6/1995 | Petrak | 277/349 |
| 5,704,124 | A | * | 1/1998 | Trauzettel | 29/898.04 |
| 5,722,812 | A | | 3/1998 | Knox et al. | |
| 5,797,589 | A | * | 8/1998 | Kalebjian et al. | 251/305 |
| 5,957,461 | A | * | 9/1999 | Ulrich | 277/569 |
| 6,149,158 | A | * | 11/2000 | Tripathy | 277/307 |
| 6,287,014 | B1 | * | 9/2001 | Salla | 384/546 |
| 6,309,174 | B1 | * | 10/2001 | Oklejas et al. | 415/104 |

* cited by examiner

*Primary Examiner*—Edward K. Look
*Assistant Examiner*—James M. McAleenan
(74) *Attorney, Agent, or Firm*—Bracewell & Patterson, L.L.P.

(57) ABSTRACT

A method of installing an annular bearing element within a centrifugal pump utilizes a mechanical staking operation. The bearing element locates within a receptacle of a pump stage that is surrounded by a retaining wall. Once the bearing element is located within the retaining wall, the retaining wall is permanently deformed at various points against the bearing element. The bearing element, if of a hard wear resistant metal, may have flats for the circumferentially spaced apart deformations to locate within. The bearing element may be a thrust washer for transmitting downward thrust, or it may be a radial support bearing sleeve.

29 Claims, 3 Drawing Sheets

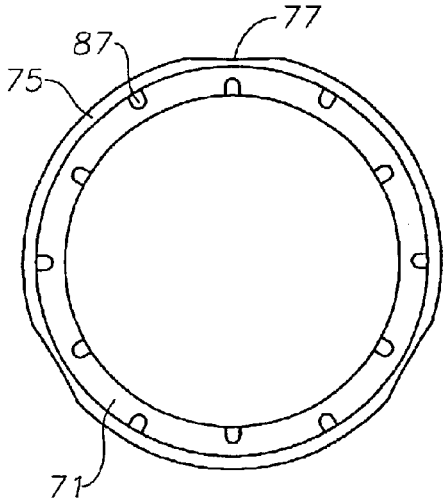
Fig. 8
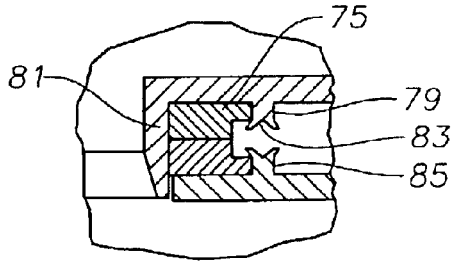
Fig. 9
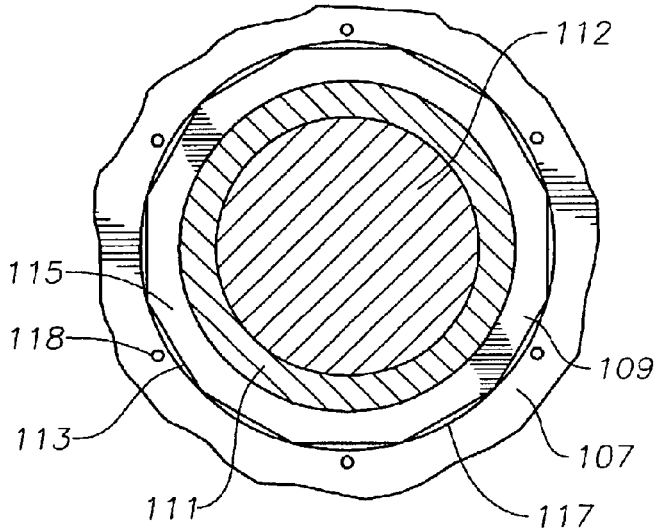
Fig. 10
Fig. 11
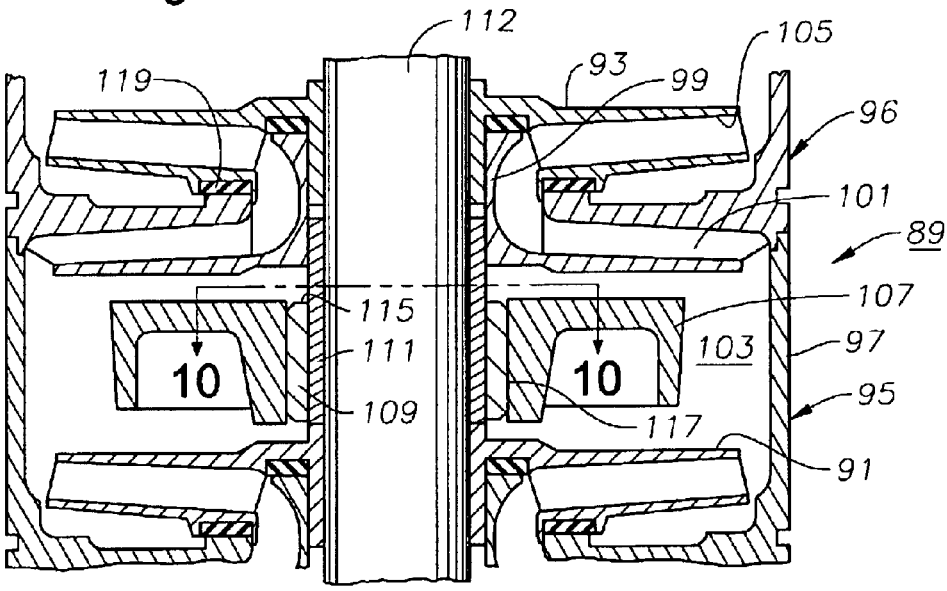

ATTACHMENT OF BEARING ELEMENTS BY DEFORMATION

FIELD OF THE INVENTION

This invention relates in general to centrifugal pump stages, and in particular to a method of attaching radial and axial support bearing elements.

BACKGROUND OF THE INVENTION

Centrifugal pumps for petroleum production are made up of a large number of stages. Each stage has an impeller that is rotated by a shaft driven by an electrical motor. Each impeller is located within a stationary diffuser. Each diffuser has passages that extend downstream and radially inward toward the shaft for receiving fluid from an upstream impeller and delivering the fluid to a downstream impeller. Each impeller has a central inlet and passages that extend outward in a downstream direction for delivering well fluid to a downstream diffuser.

The rotation of the impeller causes down thrust. Typically, each impeller is free to float axially on the shaft, and transmits the down thrust to its mating diffuser. Furthermore, thrust washers are located between the mating surfaces for handling the rotating sliding engagement between the impeller and the diffuser.

One type of thrust washer is made of phenolic material, which is not particularly hard. Another type, which is used for abrasive well fluid conditions, is of a hard, wear resistant metal such as tungsten carbide. The diffuser and impeller are cast of a metal such as Ni-Resist. Normally, the thrust washer is attached to the impeller for rotation therewith, such as by adhesive or by an interference fit. One problem with adhesive is that the bonding surface of the impeller must be very clean and free of oil. Also, the adhesive has to have time to cure. Further, in high temperature wells, the temperature may exceed that of the adhesive, causing it to deteriorate. If the thrust washer begins to spin relative to the impeller, damage to the impeller may occur.

An interference fit requires a high tolerance for the mating components. Also, it may not be as reliable as the adhesive because variations in the force fit installation. The differences in the coefficient of expansion of the impeller and a tungsten carbide thrust washer could cause the thrust washer to become loose at high temperatures. An interference fit required to hold a tungsten carbide thrust washer at high temperatures may be so large that the thrust washer fractures during assembly.

The diffuser has an internal bearing support that receives a bearing sleeve for engaging the rotating shaft. The bearing sleeve is typically installed in the bearing support by heat shrink and force fit techniques. In high temperature operations, the differences in thermal expansion of the bearing sleeve can cause the bearing sleeve to become loose and fall out or to spin in the bearing holder of the diffuser. Force fits may not be successful when the plastic deformation of the bearing holder material of the diffuser causes the bearing to become loose at high temperatures. An interference fit required to hold the bearing sleeve at high temperatures may be so large that the bearing fractures during assembly.

SUMMARY OF THE INVENTION

The bearing element for a centrifugal pump assembly is installed in a receptacle of a bearing holder, which may be a portion of an impeller or a portion of a diffuser. The receptacle has a retaining wall located adjacent the bearing element. The retaining wall is permanently deformed against the bearing element to prevent rotation.

The mechanical deformation involves staking or bending portions of the retaining wall inward. These deformed portions are spaced circumferentially apart from each other around the retaining wall. Recesses may be provided on the outer diameter of the bearing element for receiving the deflected portions of the retaining wall therein. The recesses may be flats that are circumferentially spaced around the bearing element. The flats may be in axial planes or, they may be inclined bevels located at the intersection of the sidewall with an end of the bearing element.

BRIEF DESCRIPTION OF THE DRAWINGS

FIG. 8 is a plan view of one of the thrust washers of the pump stage of FIG. 7.

FIG. 9 is a partial sectional view of the pump stage of FIG. 7.

FIG. 10 is a sectional view of the pump stage of FIG. 11, taken along the line 10—10 of FIG. 11.

FIG. 11 is a sectional view of a third embodiment of a pump stage constructed in accordance with this invention.

DETAILED DESCRIPTION OF THE PREFERRED EMBODIMENT

Figure 1:
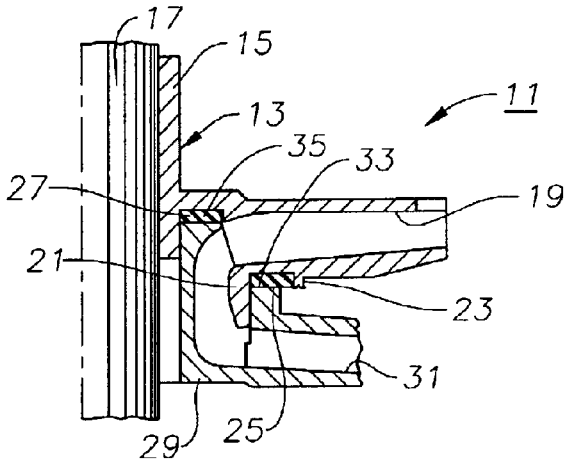
FIG. 1 is a partial sectional view of a portion of a pump stage constructed in accordance with this invention.
Figure 2:
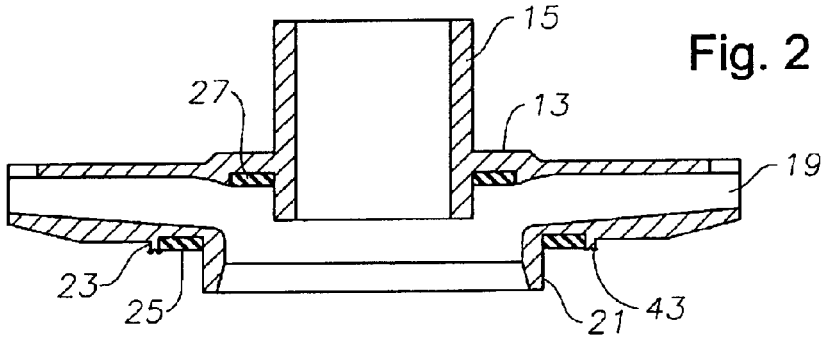
FIG. 2 is an axial sectional view of the impeller of the pump stage of FIG. 1.

Referring to FIG. 1, pump stage 11 is part of a centrifugal pump stage of a pump that is particularly used for petroleum production. Normally, such a pump has a large number of pump stages 11, each having an impeller 13 that has a hub 15 mounted to a shaft 17 for rotation therewith. In most pumps, impeller 13 is free to move small distances in axial directions on shaft 17. Impeller 13 has a plurality of passages 19 that extend from an upstream inlet outward to the periphery of impeller 13. A skirt 21 surrounds the central inlet and depends downward or in upstream direction. A retaining wall 23 extends downward from the lower or upstream side of impeller 13 concentric with the axis and spaced radially outward from skirt 21.

Skirt 21 and retaining wall 23 define an annular receptacle for receiving an outer thrust washer 25. A second or inner thrust washer 27 may be located on impeller 13. Thrust washers 25, 27 are both secured in receptacles in a manner to cause them to rotate with impeller 13. Because of the greater distance from the axis of shaft 17, outer thrust washer 25 encounters more torque than inner thrust washer 27.

Impeller 13 is rotatably carried within a diffuser 29 that is stationarily mounted in a housing (not shown). Diffuser 29 has fluid passages 31 that extend inward in a downstream direction for delivering fluid to the inlet of impeller 13 within skirt 21. Skirt 21 slidingly engages the outlet of diffuser 29. Diffuser 29 has an outer thrust surface 33 and an inner thrust surface 35, both on the downstream end. Thrust surface 33 engages thrust washer 25, while thrust surface 35 engages inner thrust washer 27.

Figure 3:
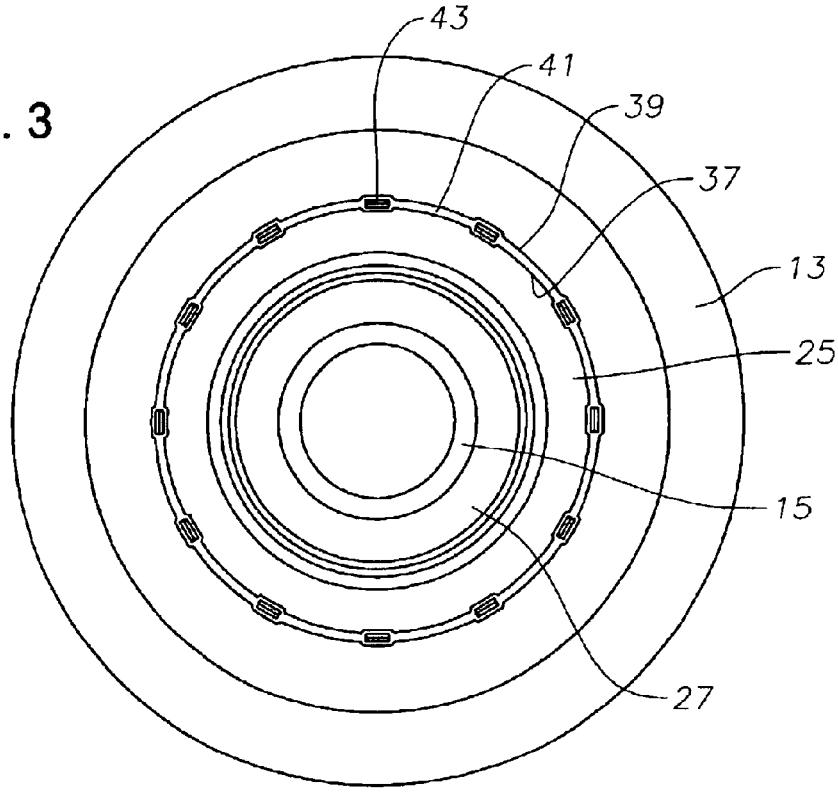
FIG. 3 is a bottom view of the impeller of FIG. 1.

Referring to FIG. 3, retaining wall 23 has an inner side 37 and an outer side 39 that are joined by a rim 41. Rim 41 is typically in a plane perpendicular to the axis of rotation of impeller 13. After thrust washer 25 is placed in the receptacle next to retaining wall 23, a plurality of deformed portions 43 are made in rim 41. As can be seen in FIG. 3, deformed portions 43 enlarge the wall thickness of retaining wall 23 between inner side 37 and outer side 39. Deformed portions 43 are spaced circumferentially around retaining wall 23 to mechanically stake or secure outer thrust washer 25 in place. Inner thrust washer 27 could be installed by the same manner, or it could be installed in a conventional manner, such as by adhesive.

Figure 5:
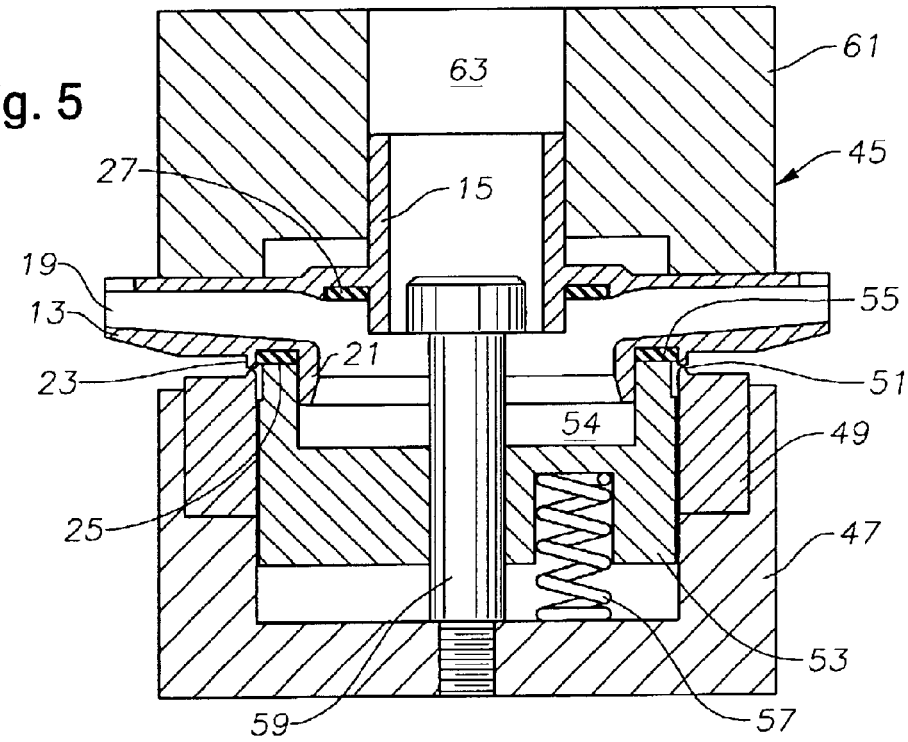
FIG. 5 is an axial sectional view of a die assembly that utilizes the die of FIG. 4.
Figure 4:
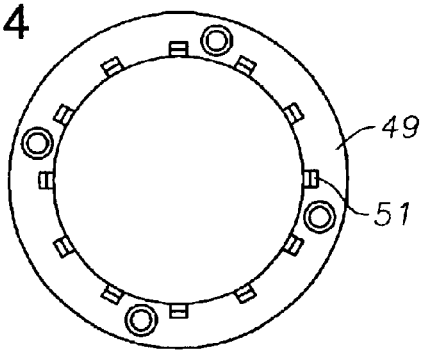
FIG. 4 is a top view of a die used for staking the thrust washer to the impeller of FIG. 2.

Referring to FIG. 5, die assembly 45 is suitable for making the deformed portions 43 (FIG. 3), although other devices could also perform the staking operation. Die assembly 45 has a lower body 47 that rigidly supports an annular die 49. Die 49 has a plurality of staking projections 51, as shown in FIG. 4, which is a top view of die 49. Each projection 51 is a sharp tooth-like member protruding from the upper surface of die 49.

A lower support 53 is reciprocally carried within lower body 47. Lower support 53 has a central cavity 54 and an annular upward facing rim 55. Rim 55 is located radially inward a slight distance from die 49 for engaging thrust washer 25. A plurality of coiled springs 57 bias lower support 53 upward. A fastener 59 extends axially through lower support 53 for retaining lower support 53 with lower body 47, but allowing axial movement of lower support 53 relative to lower body 47. A plunger 61 is located above or opposite lower body 47. Plunger 61 is adapted to engage the downstream end of impeller 13 and may be hydraulically or mechanical driven. Plunger 61 has central passage 63 for receiving hub 15 of impeller 13.

Figure 6:
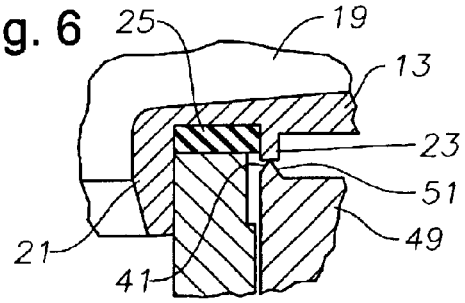
FIG. 6 is an enlarged sectional view of a portion of the assembly of FIG. 5, showing the staking operation being performed with the die assembly of FIG. 5.

In the operation of die assembly 45, impeller 13 is placed on die 49 with its wall 23 in contact with projections 51 and its skirt 21 located within cavity 54. Lower support 53 will be in contact with outer thrust washer 25. Plunger 61 is placed against the downstream end of impeller 13 with hub 15 located in passage 63. Plunger 61 is stroked toward body 47. As illustrated in FIG. 6, this causes projections 51 to embed into retaining wall rim 41, radially deforming inner and outer sides 37, 39 (FIG. 3). This deformation also causes some deformation of thrust washer 25, creating an interference fit. Springs 57 allow lower support 53 to move downward slightly as plunger 61 moves impeller 13 further toward die 49. If a staking procedure is to be used with inner thrust washer 27, a different die assembly would be required as it would need to pass through skirt 21 and engage the retaining wall surrounding inner thrust washer 27.

Figure 7:
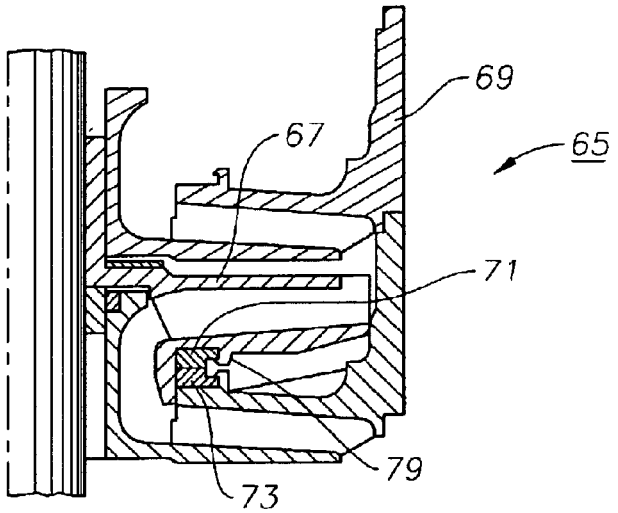
FIG. 7 is a sectional view of an alternate embodiment of a pump stage constructed in accordance with this invention.

FIG. 7 illustrates an alternate embodiment. Pump stage 65 is particularly to be used in abrasive applications, such as where well fluid has an appreciable content of sand. Impeller 67 rotates within diffuser 69. An impeller thrust washer 71 is mounted to impeller 67 for transferring downward thrust to a diffuser thrust washer 73 that is stationarily mounted to diffuser 69. Both thrust washers 71, 73 are preferably formed of a hard wear resistant material such as tungsten carbide. Thrust washers 71, 73 engage each other in rotating sliding contact.

Referring to FIG. 9, thrust washers 71, 73 are identical in this embodiment, each having an outer diameter containing a radially extending lip 75. Also, lip 75 of each thrust washer 71, 73 has a plurality of flats 77. In this embodiment, three flats 77 are shown spaced 120° from each other. Each flat 77 extends in an axial plane that is parallel with an axial plane that passes through the axis of thrust washer 71 or 73. Lip 75 has a smaller radial dimension at each flat 77, and if desired, could be substantially eliminated at each flat 77. Impeller 67 as a cylindrical retaining wall 79 that receives lip 75 of thrust washer 71. A skirt 81 depends from impeller 67, surrounds the inlet of impeller 67, and slidingly engages an outlet portion of diffuser 69.

Deformed portions 83 are formed in the rim of retaining wall 79 adjacent each flat 77. Deformed portions 83 bear against each flat 77 to prevent rotation of thrust washer 71. Flats 77 avoid having to deform any portion of the tungsten carbide washer 71 to create an interference fit. The staking operation for deformed portions 83 may be as described in connection with the first embodiment. The plan view of FIG. 8 discloses shallow recesses 87 formed in the mating surface of impeller thrust washer 71. These recesses assist in lubrication and do not form a part of this invention.

Similarly, diffuser 69 has a retaining wall 85 that closely receives the lip of diffuser thrust washer 73. It has deformed portions also that engage flats on the outer diameter of diffuser thrust washer 73. The same procedure as described in connection with the first embodiment may be used for performing the staking operation.

Referring to FIG. 11, portions of two pump stages 89 are shown, these stages being a third alternate embodiment. Impellers 91, 93 are located within diffusers 95, 96, respectively. Each diffuser 95, 96 has an outer wall or shell 97 that is stationarily mounted within a housing (not shown). Each diffuser has a central hub 99 that provides radial support for one of the impellers 91, 93. Central hub 99 also receives down thrust from one of the impellers 91, 93. Each diffuser 95, 96 has passages 101 that extend downstream and inward to an intake of one of the impellers 91, 93. A central cavity 103 is formed within outer shell 97. Fluid from upstream impeller 91 flows through central cavity 103 to diffuser passages 101 of downstream diffuser 96.

Each diffuser 95, 96 also has an integral bearing support 107 formed in central cavity 103. Bearing support 107 has an axial bore that serves as a receptacle to receive a stationary bearing sleeve 109. Bearing sleeve 109 is fixed to bearing support 107 and receives within it a rotating bushing 111 that is mounted to shaft 112. In an abrasion resistant pump, bearing sleeve 109 and bushing 111 may be made of a hard wear resistant material such as tungsten carbide.

To retain bearing sleeve 109 stationarily within bearing holder 107, a plurality of flats or bevels 113 are formed on one end of bearing sleeve 109, as shown in FIG. 10, and spaced circumferentially around the outer diameter of bearing sleeve 109. Each bevel 113 is a flat surface that is inclined relative to an axial plane parallel to an axial plane passing through the axis of shaft 112. Each bevel 113 joins an end surface 115 with an outer diameter 117 of bearing sleeve 111. A plurality of circumferentially spaced-apart deformations 118 are located in one of the end surfaces 115 of bearing holder 107, preferably the downstream end. Deformations 118 permanently deform a portion of bearing holder 107 into engagement with one of the bevels 113. Deformations 118 may be formed generally in the same manner as described in connection with the first embodiment. Because of bevels 113, no deformation of bearing sleeve 109 is required. Thrust washers 119 may be attached conventionally with adhesive, or they may be installed in a mechanical staking operation as in the other embodiments.

The invention has significant advantages. The mechanical staking operations avoids having to clean all oil from the impeller prior to securing a thrust washer. It avoids having to delay further manufacturing operations to allow the adhesive to cure. The circumferentially spaced apart deformations do not require high tolerances of the outer diameter of the thrust washer, unlike conventional force fits. As no glue is required, high temperature operations will not cause the adhesive to deteriorate. Mechanical staking also avoids the disadvantage of interference fits between two different materials that have different coefficients of expansion.

While the invention has been shown in only three of its forms. It should be apparent to those skilled in the art that it is not so limited but is susceptible to various changes without departing from the scope of the invention.

What is claimed is:

1. A method of installing an annular bearing element within a centrifugal pump stage having a rotatable impeller component and a stationary diffuser component, comprising:

(a) providing a receptacle on one of the components of the pump stage with a retaining wall;

(b placing the bearing element in the receptacle adjacent the retaining wall; then (c) deforming the retaining wall radially inward against the bearing element.

2. The method according to claim 1, wherein:

step (a) comprises providing the retaining wall with a rim and extending the retaining wall around the receptacle to define an outer diameter of the receptacle; and step (c) comprises bending circumferentially spaced-apart portions of the rim of the retaining wall inward into contact with portions of the bearing element.

3. The method according to claim 1, wherein the bearing element comprises an annular member, and the method further comprises:

forming circumferentially spaced recesses on an outer diameter of the bearing element; and step (c) comprises permanently deflecting portions of the retaining wall to the recesses.

4. The method according to claim 1, wherein the bearing element comprises an annular member, and the method further comprises:

forming flats on an outer diameter of the bearing element, the flats being spaced circumferentially around the bearing element; and step (c) comprises permanently deflecting portions of the retaining wall into the flats.

5. The method according to claim 1, wherein the receptacle is located on the diffuser component, and the bearing element comprises a sleeve having an outer diameter and an end located in a plane perpendicular to an axis of the sleeve, and the method further comprises:

forming a plurality of bevels at an intersection of the end with the outer diameter of the sleeve, the bevels being spaced circumferentially around the outer diameter of the sleeve; and step (c) comprises permanently deflecting portions of the retaining wall to the levels.

6. A method of installing an annular bearing element within a centrifugal pump stage, comprising:

(a) providing a receptacle on the pump stage with a retaining wall:

(b) placing the bearing element in the receptacle adjacent the retaining wall; then (c) deforming the retaining wall radially inward against the bearing element; wherein step (c) comprises:

providing a die with a plurality of sharp protuberances spaced in a circular array;

securing the portion of the pump stage having the receptacle in a fixture; and forcing the protuberances against the retaining wall.

7. The method according to claim 1, wherein step (a) comprises forming the receptacle on the impeller component for rotation therewith, and the method further comprises:

forming an additional receptacle on the diffuser component, placing an additional bearing element in the receptacle of the diffuser component, bending portions of additional retaining wall into contact with the additional bearing element, and placing the bearing elements in contact with each other for rotating sliding engagement.

8. The method according to claim 1, wherein step (a) comprises forming a bore within the diffuser component of the pump stage, and wherein the bore defines the retaining wall.

9. A method of manufacturing a centrifugal pump stage, comprising:

(a) forming an impeller with a plurality of passages extending downstream and outward from a central inlet;

(b) forming a retaining wall on the impeller around and spaced radially outward from the inlet, defining an annular receptacle;

(c) placing a thrust washer in the receptacle; then (d) deforming circumferentially spaced apart portions of the retaining wall against the thrust washer to retain the thrust washer in the receptacle for rotation with the impeller.

10. The method according to claim 9, wherein step (a) comprises forming a depending skirt on the impeller, the skirt defining the inlet and defining an inner perimeter of the receptacle.

11. A method of manufacturing a centrifugal pump stage, comprising:

(a forming an impeller with a plurality of passages extending downstream and outward from a central inlet:

(b forming a retaining wall around and spaced radially outward from the inlet, defining an annular receptacle;

(c) placing a thrust washer in the receptacle; then (d) deforming circumferentially spaced apart portions of the retaining wall against the thrust washer to retain it; wherein step (b) comprises:

providing the retaining wall with a circular rim; and step (d) comprises:

providing a die with a plurality of sharp protuberances spaced in a circular array;

securing the impeller in a fixture; and forcing the die and the impeller toward each other, causing the protuberances to form depressions in the rim of the retaining wall.

12. The method according to claim 9, wherein step (c) comprises forming the thrust washer with a hard, wear resistant material having an outer diameter with a plurality of flats that are circumferentially spaced around the outer diameter of the thrust washer; and step (d) comprises deforming portions of the retaining wall into the flats.

13. The method according to claim 9, further comprising:

forming a diffuser for receiving the impeller, the diffuser having passage that extend downstream and inward for supplying fluid to the inlet of the impeller, the diffuser having a bore and a downstream end surface located at a downstream end of the bore;

inserting a sleeve of hard wear resistant metal into the bore of the diffuser; and permanently deforming the downstream end surface of the diffuser against the sleeve to retain the sleeve.

14. A method of manufacturing a centrifugal pump stage, comprising:

(a) forming a diffuser with passages that extend downstream and inward or supplying fluid to an inlet of an impeller, the diffuser having a bore and a downstream end surface located at a downstream end of the bore;

(b) inserting a sleeve of hard wear resistant metal into the bore of the diffuser; and (c) permanently deforming the downstream end surface of the diffuser against the sleeve to retain the sleeve.

15. The method according to claim 14, wherein step (b) comprises forming circumferentially spaced flat surface on an outer diameter of the sleeve; and step (c) comprises deforming portions of the downstream end surface into the flat surfaces.

16. The method according to claim 14, wherein:

step (b) comprises forming circumferentially spaced bevels at an intersection of an end and an outer diameter of the sleeve; and step (c) comprises deforming portions of the downstream end surface into the bevels.

17. A centrifugal pump stage, comprising:

an impeller component rotatably mounted to a diffuser component;

a receptacle on one of the components of the pump stage having an annular retaining wall;

a bearing element in the receptacle adjacent the retaining wall; and circumferentially spaced-apart portions of the retaining wall being permanently deformed against the bearing element to retain it.

18. The pump stage according to claim 17, wherein the retaining wall encircles an outer diameter of the bearing element.

19. The pump stage according to claim 17, wherein the bearing element has a cylindrical side wall with circumferentially spaced flats formed thereon that are engaged by the spaced-apart portions of the retaining wall.

20. The pump stage according to claim 17, wherein the retaining wall is located in the diffuser, and the bearing element comprises a sleeve having an outer diameter and an end located in a plane perpendicular to an axis of the sleeve, and bevels at an intersection of the end with the outer diameter of the sleeve, the bevels being spaced circumferentially and engaged by the spaced-apart portions of the retaining wall.

21. The pump stage according to claim 17, wherein the receptacle is located on the impeller component for rotation therewith, and the bearing element is a thrust washer.

22. The pump stage according to claim 17, wherein the receptacle comprises a bore within the diffuser component of the pump stage, and wherein the bore defines the retaining wall.

23. A centrifugal pump stage, comprising:

an impeller having a plurality of passages extending downstream and outward from a central inlet, the central inlet having a circular skirt;

a concentric retaining wall located on the impeller radially outward from the skirt, defining an annular receptacle between the retaining wall and the skirt;

a thrust washer in the receptacle; and a plurality of circumferentially-spaced apart permanently deformed portions in the retaining wall that bear against the thrust washer to retain it.

24. The pump stage according to claim 23, wherein the deformed portions are located on a rim of the retaining wall.

25. The pump stage according to claim 23, wherein the thrust washer is of hard wear resistant material and has an outer diameter having a plurality of flats, each of the flats being engaged by one of the deformed portions.

26. The pump stage according to claim 23, further comprising:

a diffuser having a plurality of passages for supplying fluid to the inlet of the impeller, the diffuser having a receptacle adjacent a retaining wall and a thrust washer placed thereon, the retaining wall of the diffuser having a plurality of circumferentially spaced-apart permanently deformed portions that engage the thrust washer on the diffuser to prevent rotation, the thrust washers being in mating sliding contact with each other.

27. A pump stage comprising:

a diffuser having passages that extend downstream and inward for supplying fluid to an inlet of an impeller, the diffuser having a bore and a downstream end surface located at a downstream end of the bore;

a sleeve of hard wear resistant metal into the bore of the diffuser; and a plurality of circumferentially spaced permanently deformed portions of the downstream end surface of the diffuser in contact with the sleeve to retain the sleeve.

28. The pump stage according to claim 27, wherein a plurality of circumferentially spaced flat surfaces are located on an outer diameter of the sleeve in engagement with the deformed portions.

29. The pump stage according to claim 27, further comprising:

a plurality of circumferentially spaced bevels at an intersection of an end and an outer diameter of the sleeve in engagement with the deformed portions.

* * * * *